United States Patent [19]

Trestin

[11] 4,158,345

[45] Jun. 19, 1979

[54] BOILER FOR LIQUID AND/OR GASEOUS FUELS

[75] Inventor: Alessandro Trestin, San Bonifacio, Italy

[73] Assignee: Fer Fabbrica Europea Riscaldamento S.p.A., Italy

[21] Appl. No.: 820,041

[22] Filed: Jul. 28, 1977

[30] Foreign Application Priority Data

Mar. 17, 1977 [IT] Italy ..... 21402 A/77

[51] Int. Cl.[2] ..... F22B 23/00; F22B 27/08

[52] U.S. Cl. ..... 122/214; 122/249; 122/367 C

[58] Field of Search ..... 122/250, 214, 218, 367 R, 122/367 C, 209, 210, 211, 249

[56] References Cited

U.S. PATENT DOCUMENTS

| | | | |
|---|---|---|---|
| 462,683 | 11/1891 | Blackmore et al. | 122/218 |
| 480,286 | 8/1892 | Serpollet | 122/367 |
| 2,052,856 | 9/1936 | Truelsen | 122/367 |
| 2,151,386 | 3/1939 | Florez | 122/367 |
| 2,300,634 | 11/1942 | Schoenfeld | 122/250 |
| 3,320,933 | 5/1967 | Baier | 122/218 |

*Primary Examiner*—Kenneth W. Sprague
*Attorney, Agent, or Firm*—Steinberg & Blake

[57] ABSTRACT

An improved boiler for liquid and/or gaseous fuels, comprising a combustion chamber and a heat exchanger, wherein said heat exchanger comprises at least one element or body provided with finned conduit of a coil pattern, the axis of which lies in a plane substantially at right angles to the path of the combustion products or fumes and associated fins.

4 Claims, 11 Drawing Figures

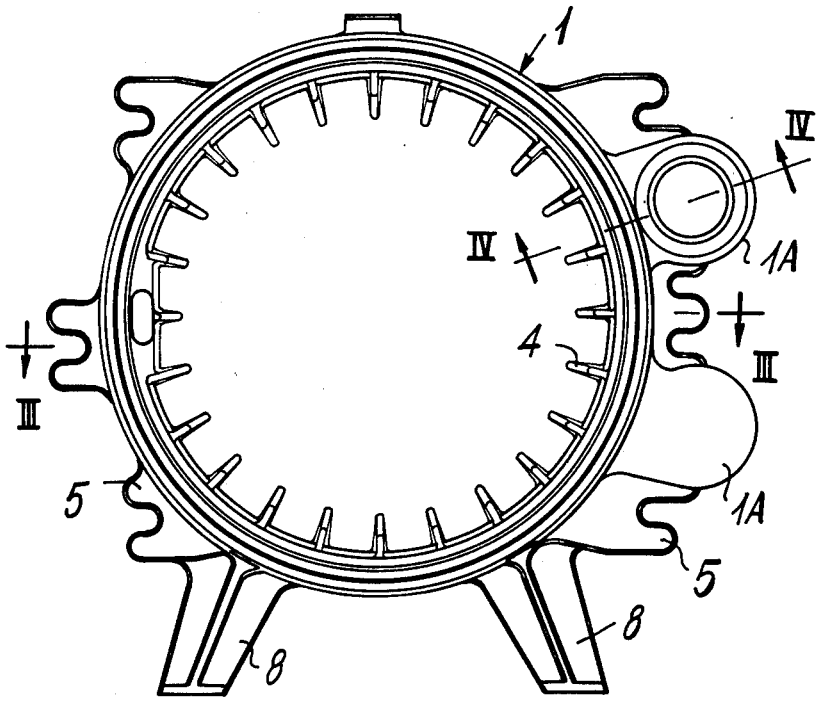

BOILER FOR LIQUID AND/OR GASEOUS FUELS

This invention relates to an improved boiler for liquid and/or gaseous fuels.

It is an object of the present invention to provide an improved boiler fitted with a novel and unique heat exchanger which, being free of dead and backwater zones, avoids overheating and steam zones.

It is another object of the present invention to provide a boiler of a limited weight as its entire surface takes evenly part in the heat exchange.

It is still another object of the present invention to provide a boiler, wherein a perfectly even rise in water temperature is attained with elimination of dew points, and by which a noiseless operation is achieved due to absence of evaporations and this with a substantially reduced overall volume.

It is another significant object of the present invention to provide a composable or modular element type of boiler, wherein the surface of the combustion chamber is fully independent of that of the heat exchanger.

According to the invention, these and still other objects, which will become more apparent from the following detailed description, are achieved by a boiler comprising a combustion chamber and a heat exchanger, which is essentially characterized in that the heat exchanger comprises at least one body provided with a finned conduit of a coil pattern, the axis of which lies in a plane substantially at right angles to the path of combustion products and fins associated therewith.

According to an important aspect of the invention, the heat exchanger consists of at least one pair of hydraulically or fluidly connected bodies placed after each other, the coil conduits of which are mutually staggered, so that conduit lengths of one body are interposed between the spaces of the other body.

According to one aspect of the invention, a composable boiler is proposed, that is a type of boiler comprising a series of bodies or elements which, when approached or joined to one another, allow to obtain a boiler having the desired heat capacity.

Prior art boilers of this type comprise elements that together with the bottom portion thereof define the combustion chamber, while defining with the top portion thereof the flue gas paths and actual heat exchanger. In these boilers, a given surface of the combustion chamber necessarily has a given surface of the heat exchanger corresponding thereto, so that boilers having a different ratio between such surfaces cannot be provided.

In order that the surface of the combustion chamber be fully independent of that of the heat exchanger, it is herein proposed that the composable type of boiler has elements or bodies that are distinct, but hydraulically interconnected, some of which forming the combustion chamber and the other forming the heat exchanger.

According to a preferred embodiment of the composable boiler, the element or elements or bodies forming the combustion chamber comprise internally finned water jacket rings, while those for the heat exchanger comprise dry rings carrying therein the finned coil extending within the space defined by the ring.

The invention can be more clearly understood from the following detailed description of a preferred embodiment thereof, as given by mere of unrestrictive example and as shown in the accompanying drawings, in which.

Figure 1:
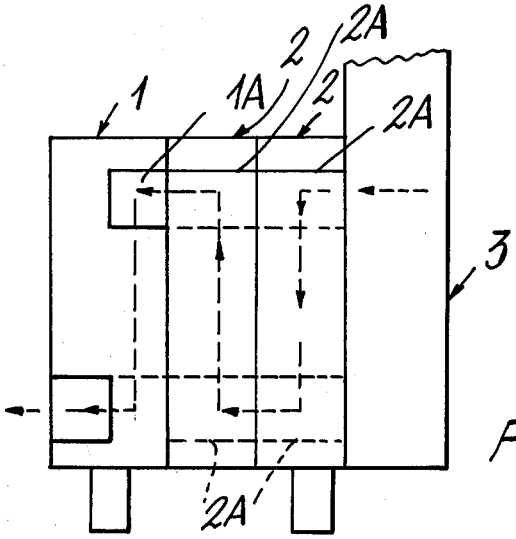
FIG. 1 is a schematic side elevational view showing a boiler made in accordance with the teachings of the invention.
Figure 2:
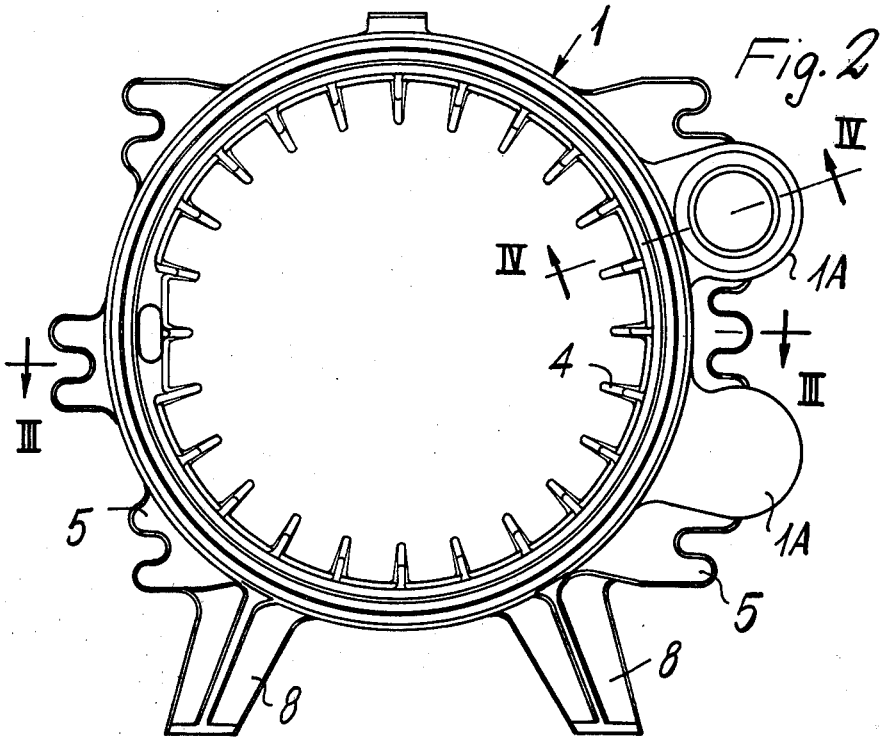
FIG. 2 is a front view of a water jacket element defining the combustion chamber.

Referring to FIGS. 1 through 9, a boiler, in the particular case shown in FIG. 1, comprises an element 1 forming the combustion chamber and made as shown in FIGS. 2 through 5, and two elements 2, possibly different from each other, forming the heat exchanger and shown in the other figures of the accompanying drawings. Elements 1 and 2 are located one after the other and joined to one another by means of tie rods (not shown) and hydraulically connected by connecting sleeves or unions 2A. The arrows show the path for the water to be heated. Reference numeral 3 designates a fume collecting conduit leading the fumes to the stack.

Element 1 is made of iron casting and is of substantially circular annular shape, having on the inside axially oriented fins 4 and on the outside ears 5 for the passage of tie rods joining elements 1 and 2, as well as internally threaded connecting unions 1A which, together with threaded sleeves, not shown, allow to effect the required hydraulic connections. Element 1 is internally hollow and such a cavity 6 forms its water jacket. At a location between the two unions 1A, a partition 7 is provided in jacket 6, causing water entering in one union 1A to exit from the other. Element 1 is also provided with bearing feet 8.

One of said elements 2, forming the actual heat exchanger and which is shown in FIGS. 6 through 9, is made of iron casting, is of substantially circular ring shape and its annular wall is "dry", or not a water jacket wall. A coil conduit 9 is integral with said ring and extends within the space defined by the ring and is hydraulically connected with unions 2A located at the opposite sides of the vertical plane. This coil conduit 9 is provided with fins 10 parallel to one another and lying on planes normal to the coil axis. Also element 2 is provided with ears 5 and may be fitted with bearing feet.

The two elements 2, comprising the heat exchanger, may be identical to each other, but preferably the right-hand end element (FIG. 1) will have a coil with four instead of three straight lengths and, looking the boiler from one end, these four straight lengths will be located in interspaces "A" between the three straight lengths for the coil of the other element 2.

The above described boiler is operable with liquid and gaseous fuels by using conventional burners for such fuels.

Figure 10:
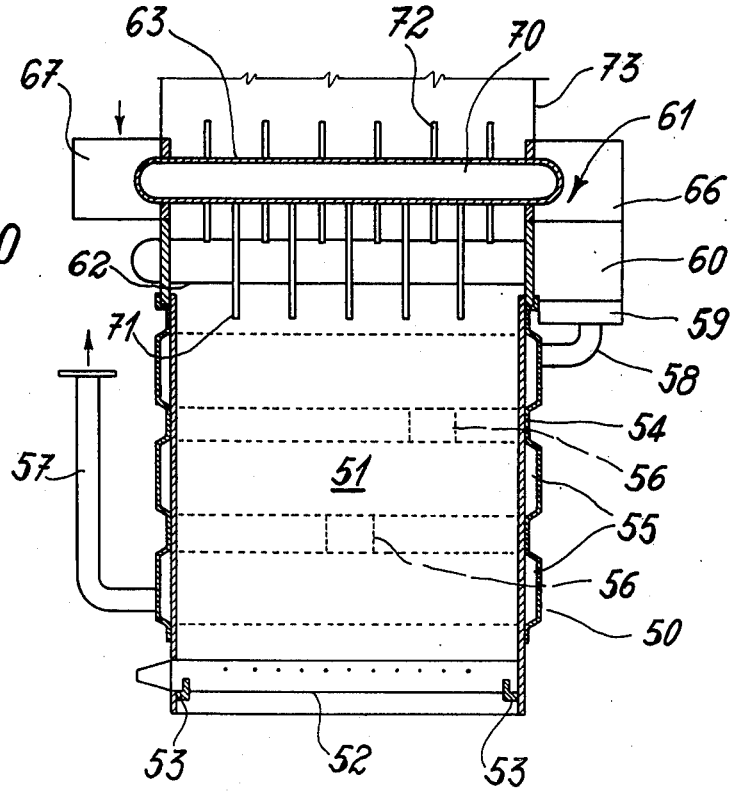
FIG. 10 is a schematic vertical sectional view showing a gas boiler.
Figure 11:
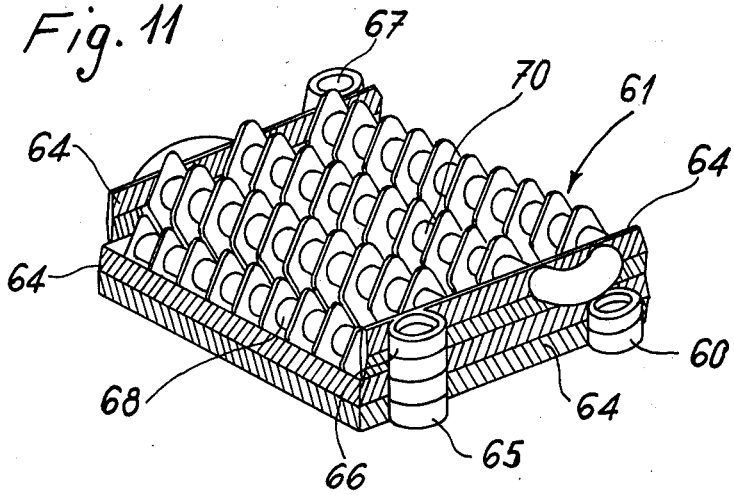
FIG. 11 is a perspective view of the heat exchanger for the boiler shown in FIG. 10.

A gas boiler is shown in FIGS. 10 and 11, this boiler operating with atmospheric air burners and incorporating a cast iron heat exchanger made in accordance with the inventive teachings.

In this embodiment, reference numeral 50 designates the sheet or plate shell, defining the combustion chamber 51 and at the bottom thereof the atmospheric air gas burner 52 is placed and carried in any known manner (for example on mountings 53), this burner comprising a tube perforated along its upper side.

Shell 50 is of rectangular cross-section and has a double wall 54 defining with its first wall a series of water rings 55 interconnected by transverse connections 56. The lower water ring is connected to a tube 57 serving for connection to the heating system, not shown. The upper ring is also connected to a tube 58 carrying a connector 59, thereby being connected to a union 60 of the heat exchanger, designated as a whole at 61. The heat exchanger comprises two elements or bodies 62 and 63, superimposed to each other and bearing against each other through end flanges 64.

Body 62 is of substantially rectangular contour matching the outlet of combustion chamber 61 and has a second union 65 on the same side of union 60. This union 65 is hydraulically connected through a conventional socket, not shown, to a union 66 of body 63. At the opposite side, body 63 has a union 67 for connection to the system.

Figure 6:
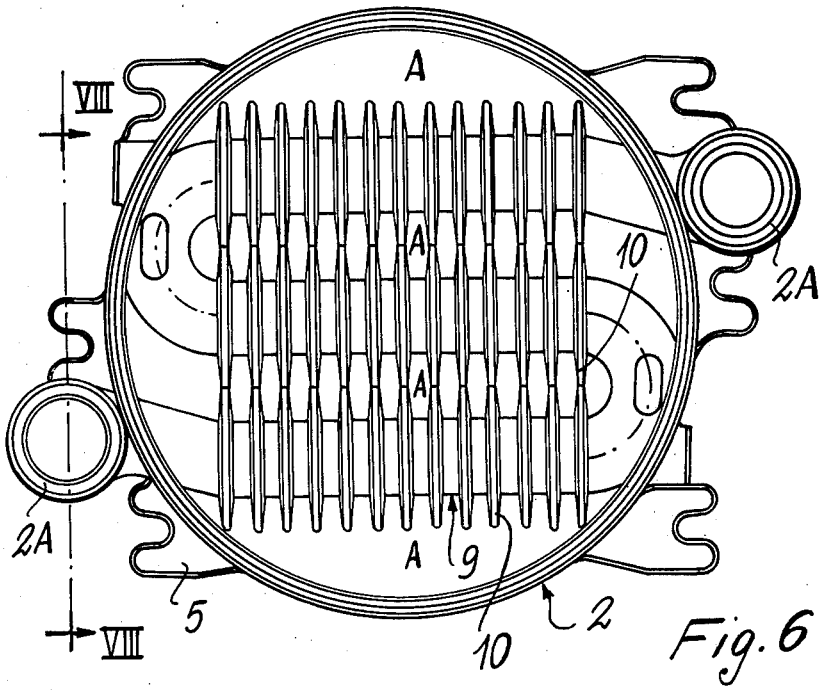
FIG. 6 is a front view showing an element of heat exchanger.
Figure 7:
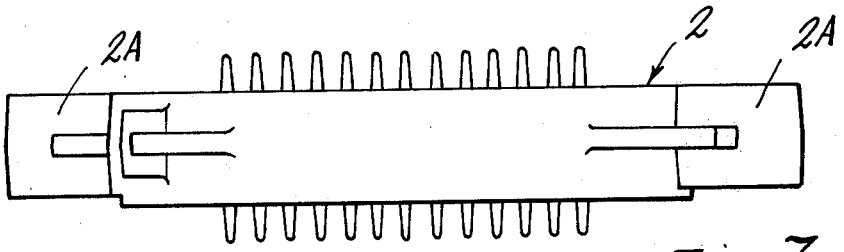
FIG. 7 is a plan view of the element shown in FIG. 6.
Figure 3:
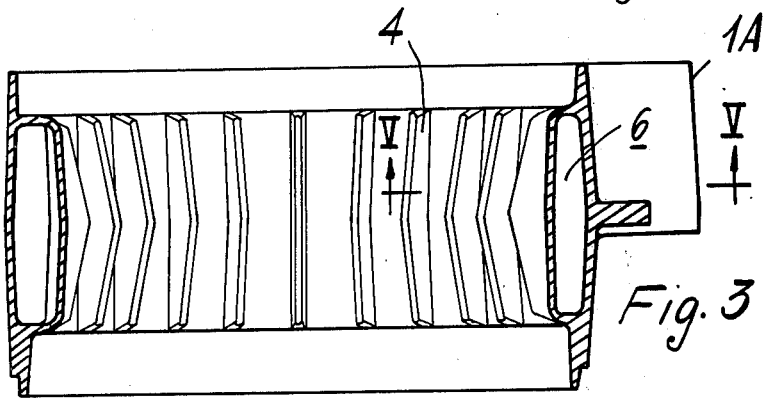
FIG. 3 is a sectional view along line III—III of FIG. 2.
Figure 4:
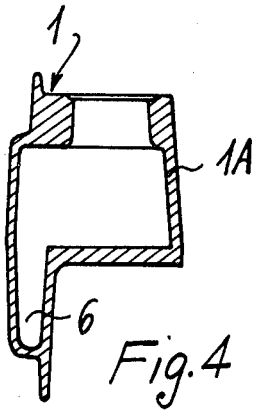
FIG. 4 is a fragmentary sectional view along line IV—IV of FIG. 2.
Figure 5:
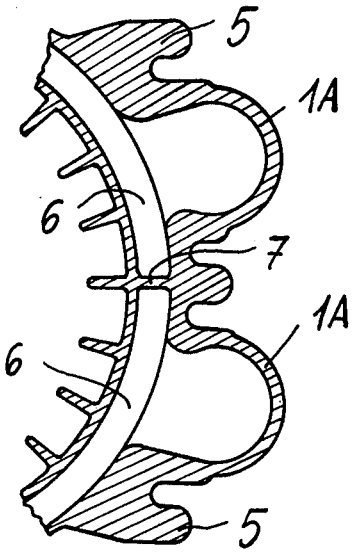
FIG. 5 is a fragmentary sectional view along line V—V of FIG. 3.
Figure 8:
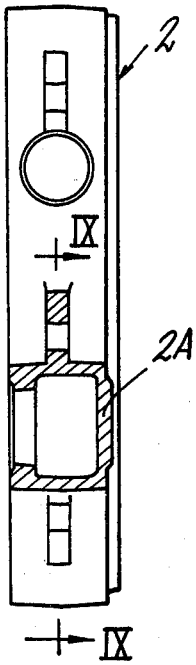
FIG. 8 is a sectional view along line VIII—VIII of FIG. 7.
Figure 9:
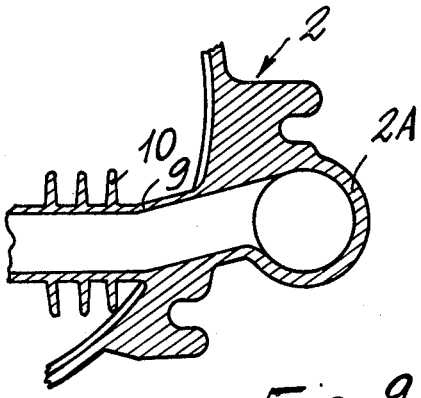
FIG. 9 is a fragmentary sectional view along line IX—IX of FIG. 8.

In this embodiment, body 62 has a coil 68 similar to that of FIG. 6, but having four straight lengths and three connecting curves, while coil 70 of body 63 coincides with that of FIG. 6. Thus, as above set forth, the straight lengths of one coil are interposed in the spaces of the other coil. Additionally, fins 72 of body 63 are comb-like interposed between fins 71 of body 62, as shown in FIGS. 9 and 10.

A conduit 73 leading to the stack is provided downstream of the heat exchanger.

What is claimed is:

1. An improved boiler for liquid and/or gaseous fuels, comprising: a combustion chamber and a heat exchanger, said heat exchanger comprising at least one pair of hydraulically connected heat exchanger bodies located one after the other, each of said heat exchanger bodies having an axis and being provided with a finned conduit having a coil pattern defined by conduit lengths, said axis lying in a plane substantially at right angles to the path of the combustion products or fumes through said conduit and associated fins and further wherein said coil conduits and fins in the respective heat exchanger bodies are mutually staggered with respect to each other so that the conduit lengths of one body are interposed between the spaces defined between the conduit lengths of the other body.

2. A boiler according to claim 1 further comprising a sheet or plate combustion chamber defining interconnected water rings.

3. A boiler according to claim 1, having intercomposable elements or bodies, that are hydraulically interconnected, at least one of said bodies forming the combustion chamber and at least another body forming the heat exchanger.

4. A boiler according to claim 3, wherein the element or elements or bodies forming the combustion chamber comprise internally finned water jacket rings, while the element or elements of the heat exchanger comprise dry rings carring an integral finned coil extending in the space defined by the ring.

* * * * *